US005259165A

United States Patent [19]

Koyama

[11] Patent Number: 5,259,165

[45] Date of Patent: Nov. 9, 1993

[54] SUPPORTING METAL FITTINGS FOR DOUBLE BEAMS

[75] Inventor: Masayoshi Koyama, Kawasaki, Japan

[73] Assignee: Tomoe Kogyo Kabushiki Kaisha, Kanagawa, Japan

[21] Appl. No.: 927,843

[22] Filed: Aug. 10, 1992

[51] Int. Cl.[5] ..... E04C 3/00

[52] U.S. Cl. ..... 52/584; 403/387; 403/388; 52/730.1; 52/730.6

[58] Field of Search ..... 52/584, 712, 703, 698, 52/730.1, 730.6; 248/72; 411/400, 401, 368; 403/387, 388

[56] References Cited

U.S. PATENT DOCUMENTS

| | | | |
|---|---|---|---|
| 1,854,241 | 4/1932 | Adams | 52/584 X |
| 1,893,481 | 1/1933 | Adams | 52/584 X |
| 2,570,169 | 10/1951 | Verhagen | 52/584 X |
| 2,686,699 | 8/1954 | Davis et al. | 52/584 X |
| 2,926,350 | 2/1960 | Saul | 403/388 X |
| 3,363,382 | 1/1968 | Forrest | 52/584 X |
| 3,590,542 | 7/1971 | Gallay | 52/584 X |
| 4,021,991 | 5/1977 | Hotz | 403/388 |
| 4,350,318 | 9/1982 | Gallis | 52/584 X |
| 4,409,906 | 10/1983 | Alneng | 52/584 X |
| 4,798,029 | 1/1989 | Carlton | 403/387 X |
| 4,802,422 | 2/1989 | Beard | 403/387 X |
| 5,020,678 | 6/1991 | Klein | 403/388 X |

FOREIGN PATENT DOCUMENTS

| | | | |
|---|---|---|---|
| 978964 | 4/1951 | France | 411/401 |
| 667090 | 2/1952 | United Kingdom | 403/307 |

OTHER PUBLICATIONS

Provisional Specification, Jenkins, Improvements in and Relating to Aerial Mountings, 808818, 1959.

*Primary Examiner*—Carl D. Friedman
*Assistant Examiner*—Beth A. Aubrey
*Attorney, Agent, or Firm*—Flynn, Thiel, Boutell & Tanis

[57] ABSTRACT

Supporting metal fittings for double beams comprising, double beams which are composed of two angles disposed in parallel with each other at a given interval, an upper metal fitting having notched portions in which the upper portions of the double beams are engaged, said upper metal fitting also having a tongue portion which engages between the double beams, a lower metal fitting having retainers by which the lower portion of the double beams is retained, said lower metal fitting also having a tongue portion which engages between the double beams, and a fixing member coupled to both the upper and lower metal fittings and inserted between the double beams for fixing them together, enabling the easy manufacturing of the supporting metal fittings for double beams for installing ducts, etc., using non-machined angles.

13 Claims, 8 Drawing Sheets

SUPPORTING METAL FITTINGS FOR DOUBLE BEAMS

BACKGROUND OF THE INVENTION

1. Field of the Invention:

The present invention relates to a supporting metal fitting for use in installing ducts, pipes, instruments, air conditioners, etc. on a ceiling of a building and the like.

2. Prior Art:

Conventionally, when ducts, pipes, instruments air conditioners, etc. are installed inside a building, there is employed a method comprising the steps of previously preparing a double beam arrangement for use on a portion adjacent to the ceiling of the building, mounting metal fittings on the double beam arrangement and suspending such ducts, etc. by the metal fittings mounted on the double beam arrangement.

The conventional double beam arrangement comprises two L-type beams (L-beams), each having first and second sides extending in an angled relationship to each other as illustrated in FIGS. 1 and 2.

In the double beam arrangement the L-beams, or as generically referred to hereinafter, double beams a, are disposed in a back to back spaced apart relationship with a gap c provided therebetween so that a lifting metal fitting b can be inserted into the gap c. The gap c is defined, as illustrated in FIG. 1, by welding a spacer d formed of a round rod to the angles a at a given interval therebetween. The gap c is also defined by interposing a collar e between the angles a and inserting a bolt f into the angles a and the collar e so as to fasten them by a nut g.

However, since it takes time and labor for providing the gap by welding or fastening by the bolt and the nut, and various sizes of the angles should be manufactured depending on a hanging load, there is such a drawback that the custody and the maintenance of the angles are troublesome.

If they were cut to a necessary length at a building site, remaining portions of angles after cutting can not be used for other purposes, which renders the angles to be wasteful.

SUMMARY OF THE INVENTION

It is an object of the present invention to improve the drawbacks of the conventional supporting metal fittings and to provide supporting metal fittings for L-beams capable of forming a double beam arrangement without machining the L-beams.

To achieve the object, the supporting metal fittings for double beams which are each composed of first and second sides are provided. The first sides are disposed in parallel in a back to back relationship with each other and spaced away from each other at a given interval. An upper metal fitting having notched portions in which the upper portions of the double beams are engaged and a tongue portion which engages in a gap between the double beams, a lower metal fitting having retainers by which the lower portions of the double beams is retained and a tongue portion which engages in the gap between the double beams, and a fixing member coupled to both the upper and lower metal fittings and inserted into the gap between the double beams for fixing them together.

With the arrangement set forth above, it is possible to manufacture the double beams capable of suspending the ducts, pipes, air conditioners, etc. with ease even at a building site.

DESCRIPTION OF THE PREFERRED EMBODIMENT

First Embodiment (FIGS. 3 to 7):

Supporting metal fittings for double beams according to the first embodiment of the present invention will be described with references to FIGS. 3 to 7.

FIGS. 3 to 7 illustrate supporting metal fittings employing double beams having two sides.

Each of the supporting metal fittings 1 comprises an upper metal fitting 2 and a lower metal fitting 3 respectively formed by bending a metal plate.

Figure 4:
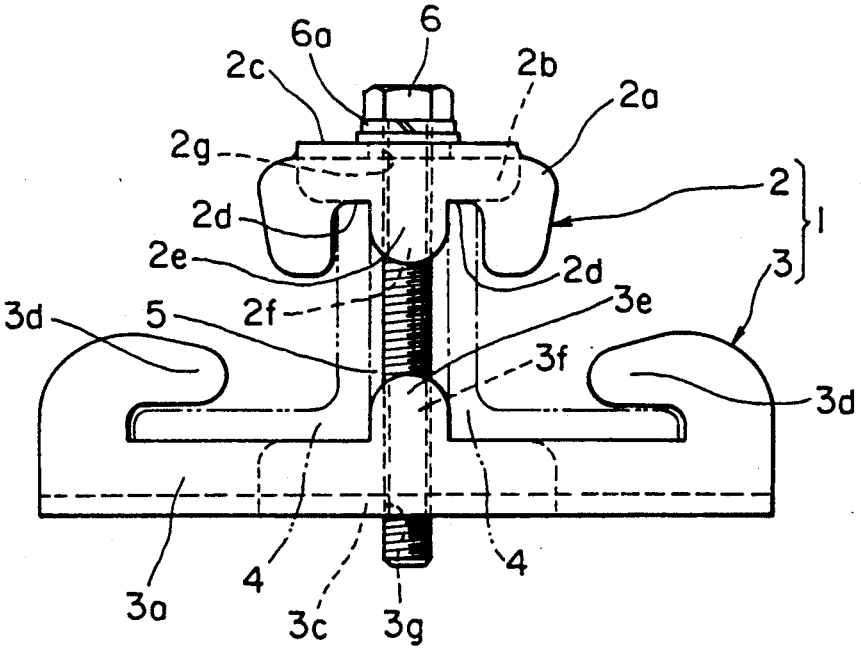
FIG. 4 is a front view of the supporting metal fittings for double beams in FIG. 3.

The upper supporting metal fitting 2 has a substantially U-shape in cross section and has an opening which is directed downward. The upper supporting metal fitting 2 comprises side plates 2*a* and 2*b* and an upper plate 2*c*. The side plate 2*a* has notched portions 2*d* in which upper ends of a pair of beams 4, which are disposed back to back, are engaged at a given interval defining a gap 5 therebetween. The side plate 2*a* has a circular arc shaped tongue portion 3*e* protruding therefrom between the notched portions 2*d* so as to facilitate the upper ends of the beams 4 into the notched portions 2*d* as illustrated in FIG. 4. Another side plate 2*b* of the upper metal fitting 2 has a narrow vertical width and has a tongue portion 2*f* which is the same as the tongue portion 2*e* of the side plate 2*a* at the location and the shape thereof. The upper plate 2*c* has a length which is substantially the same as the length of the side plate 2*b* but slightly shorter than the length of the side plate 2*a*. The upper plate 2*c* has a small hole 2*g* at the central portion thereof through which the fixing member 6 such as a bolt can be inserted.

The lower metal fitting 3 of the supporting metal fitting body 1 has a substantially U-shape in cross section and has an opening which is directed upward. The lower metal fitting 3 has side plates 3*a* and 3*b* and a lower plate 3*c* in which the side plates 3*a* and 3*b* are longer than the side plates 2*a* and 2*b* of the upper metal fitting 2.

The side plate 3*a* has a length longer than the width of the lower portion of the double beams 4 which are composed of two angles spaced away from each other at a given interval. The side plate 3*a* has hooked retainers 3*d* at both sides thereof and a tongue portion 3*e* protruding upward from the central portion thereof for receiving the tip ends of the lower portion of the double beams 4 therebetween to engage them as illustrated in FIG. 4. The tongue 3*e* projects upward at the central portion of the side plate 3*a* between the retainers 3*d* to engage into the space between the double beams 4 from the lower portion of the space to thereby hold the double beams 4 at a given interval. The tip end of the tongue portion 3*e* arches like tongue portions 2*e* and 2*f* of the upper metal fitting 2. Another side plate 3*b* of the lower metal fitting 3 has substantially the same length as that of the side plate 2*a* of the upper metal fitting 2. The side plate 3*b* has a tongue portion 3*f* which protrudes upward from the central portion thereof and has a shape same as the side plate 3*a*. The lower plate 3*c* has a substantially a shape of trapezoid so as to connect to the long side plate 3*a* to the short side plate 3*b* and has a screw hole 3*g* which penetrates the central portion thereof and into which a fixing member 6 is screwed.

An operation of the supporting metal fittings will be described with reference to FIGS. 6 and 7.

Figure 6:
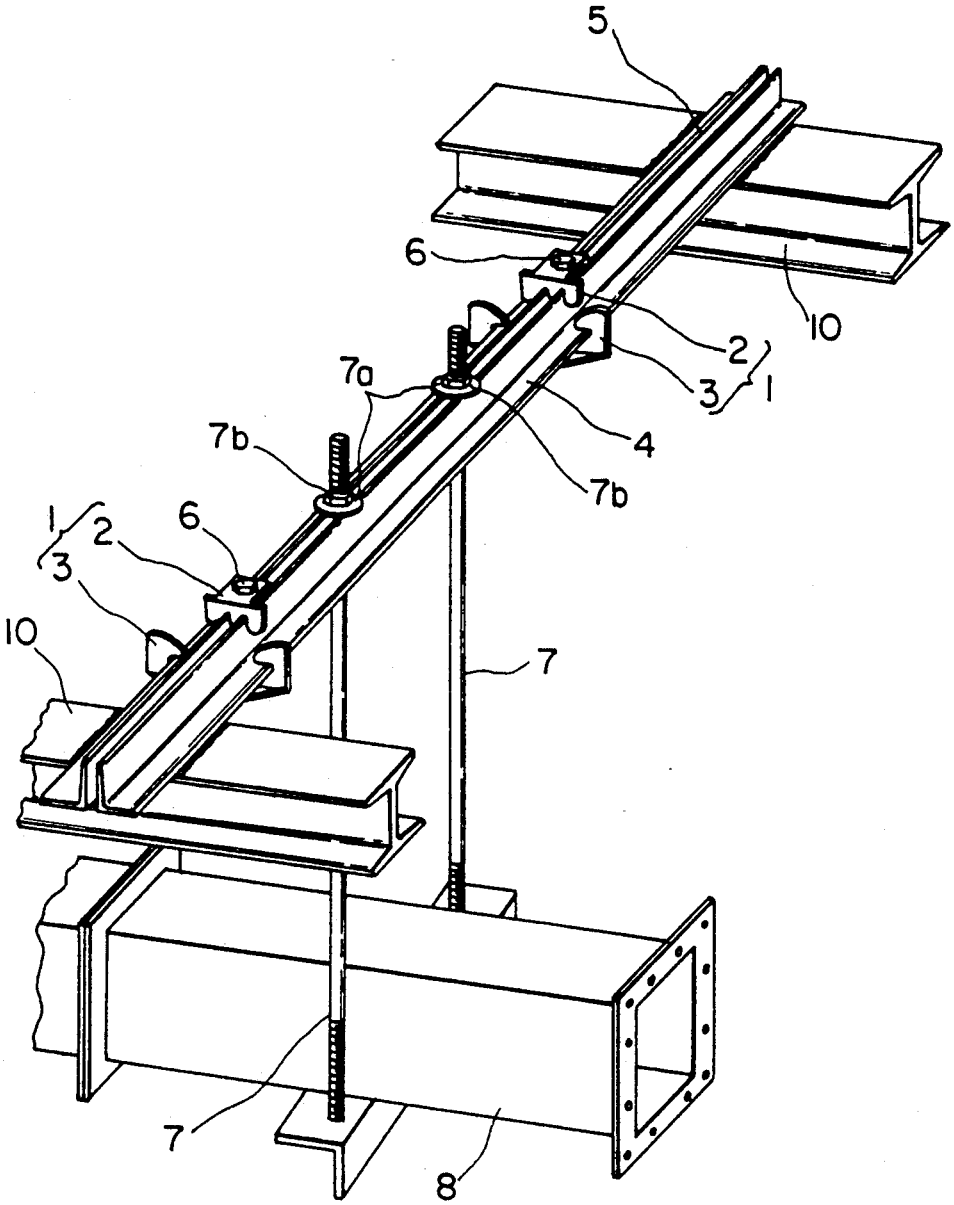
FIG. 6 is a view showing a first example of using the supporting metal fittings for double beams in FIG. 3.
Figure 7:
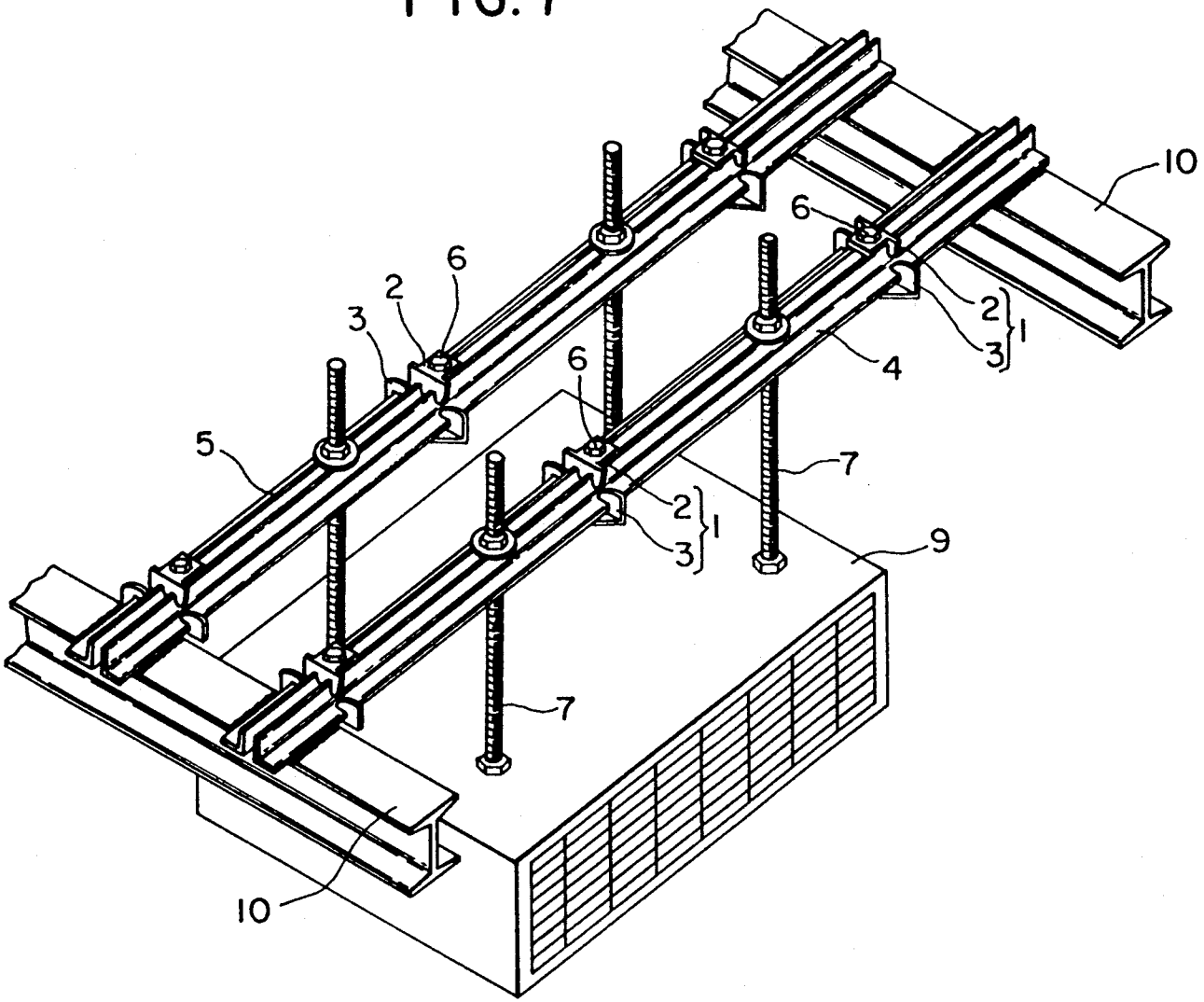
FIG. 7 is a view showing a second example of using the supporting metal fittings for double beams in FIG. 3.

FIG. 6 shows the case where the duct 8 is suspended and installed and FIG. 7 shows the case where the air conditioner 9 is suspended and installed using lifting metal fittings 7.

In either case, the angles are cut to be fit to a span between iron beams 10 and be capable of being placed on the iron beams 10 and disposed back to back and parallel with each other so as to form the double beams 4. The upper metal fittings 2 are attached to the upper portion of the double beams 4 at arbitrary intervals in the longitudinal direction of the double beams 4. The lower metal fittings 3 are attached to the lower portion of the double beams 4 in the same manner as the upper metal fittings 2.

Figure 1:
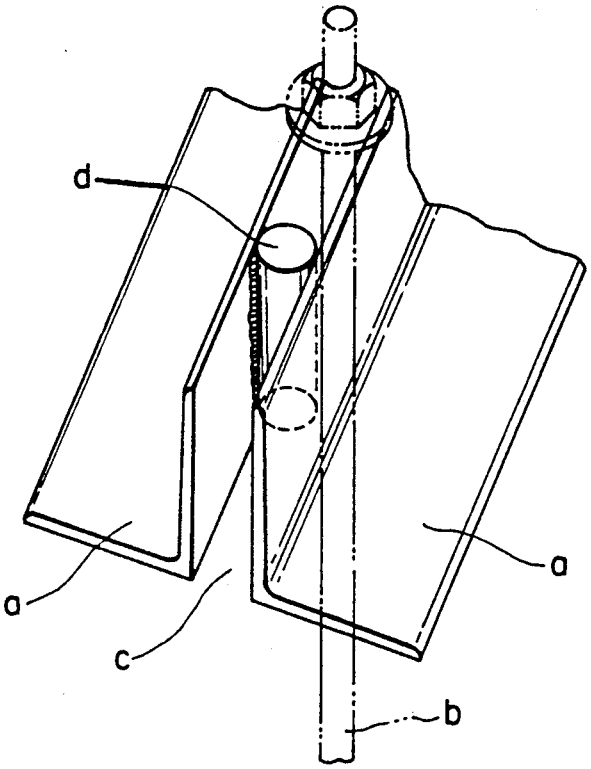
FIG. 1 PRIOR ART
FIG. 1 is a perspective view showing conventional double beams.
Figure 2:
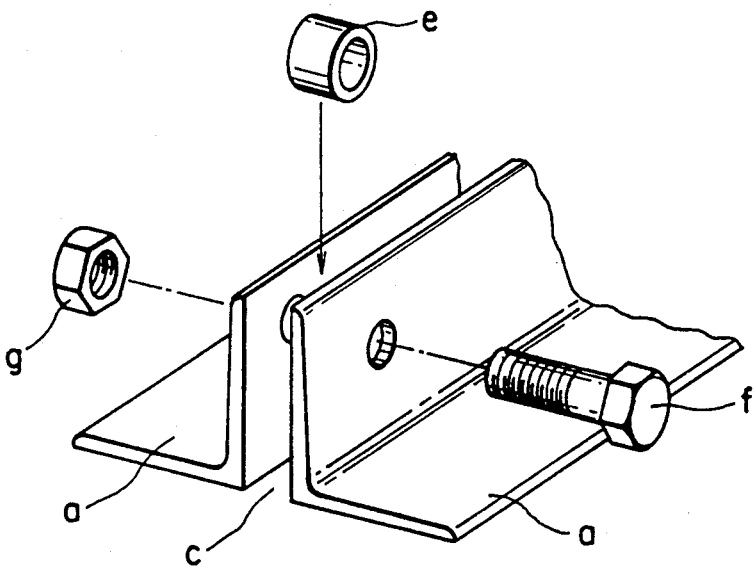
FIG. 2 PRIOR ART
FIG. 2 is a perspective view showing another conventional double beams.
Figure 3:
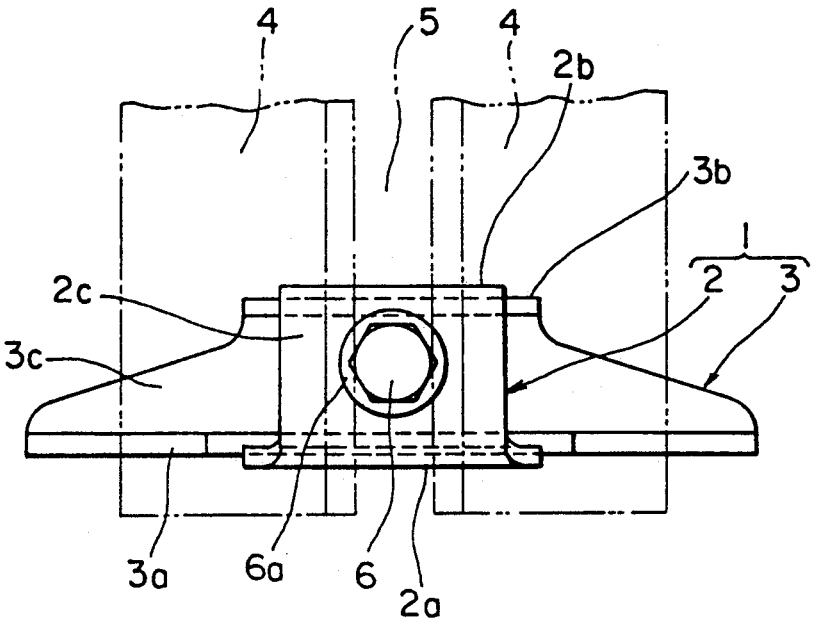
FIG. 3 is a plan view showing supporting metal fittings for double beams according to a first embodiment of the present invention.
Figure 5:
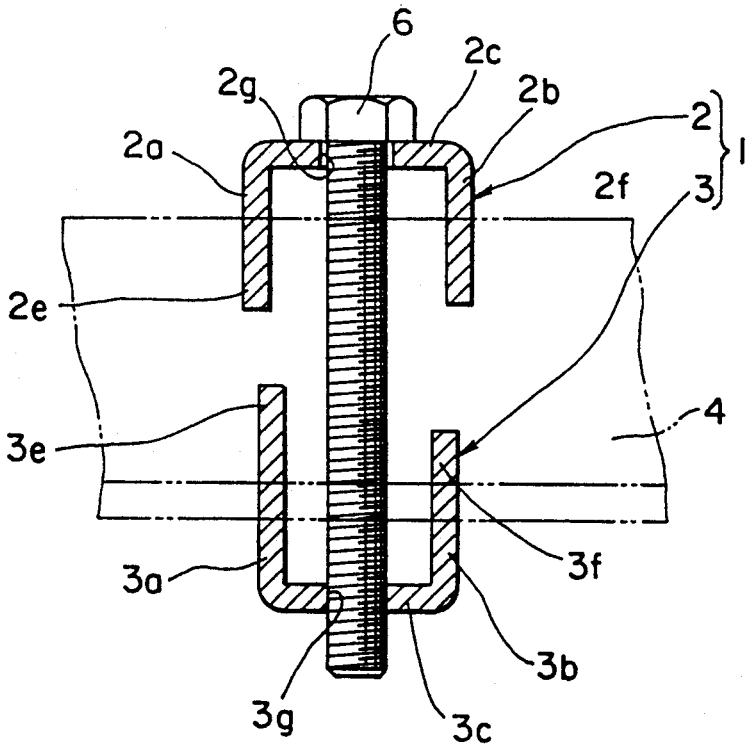
FIG. 5 is a side view of the supporting metal fittings for double beams in FIG. 3.

The upper metal fitting 2 is attached to the double beams 4 in the manner that the upper portions of the double beams 4 are inserted into the notched portions 2*d* of the side plates 2*a* and the tongue portions 2*e* and 2*f* of the side plates 2*a* and 2*b* are inserted downward into the gap defined between the double beams 4 as illustrated in FIGS. 3 to 5.

The lower metal fitting 3 is attached to the double beams 4 in the manner that the lower portions of the double beams 4 are lowered so that the lower sides of the double beams are positioned on the upper surface of the side plate 3*a* of the lower metal fitting 3 whereby the tip ends of the lower portions of the double beams 4 are engaged with the retainers 3*d* of the lower metal fitting 3*a*, as illustrated in FIG. 4 and at the same time, the tongue portions 3*e* and 3*f* of the side plates 3*a* and 3*b* are inserted into the gap between the double beams 4.

At the state where the upper and lower metal fittings 2 and 3 are attached to the double beams 4, the fixing member 6, having a washer 6*a* at the head portion thereof and a threaded portion at the lower portion thereof, is inserted into the gap between the double beams 4 from the small hole 2*g* of the upper metal fitting 2 and the lower portion thereof is screwed into the screw hole 3*g* of the lower metal fitting 3 to fasten the fixing member 6.

Upon completion of the attachment of the necessary numbers of supporting metal fittings 1 to the double beams arranged in the longitudinal direction of the double beams, both ends of the double beams are fixed to the iron beams 10 of the building by welding, etc.

The duct 8 and the air conditioner 9 are installed as follows. The upper ends of the lifting metal fittings 7 are inserted into the gap between the double beams and nuts 7*b* are screwed onto the upper threaded portions of the lifting metal fittings 7 by way of washers 7*a* whereby the upper portions of the lifting metal fittings 7 can be attached to the double beams 4. The duct 8 and the air conditioner 9 can be suspended at the lower portions of the lifting metal fittings 7 in the conventional manner. A sufficient strength can be obtained by the double beams for a heavy hanging load since the supporting metal fittings 1 keep the gap between the double beams 4 constant.

Second Embodiment (FIGS. 8 to 11)

Supporting metal fittings for double beams according to a second embodiment will be described with reference to FIGS. 8 to 11.

Figure 8:
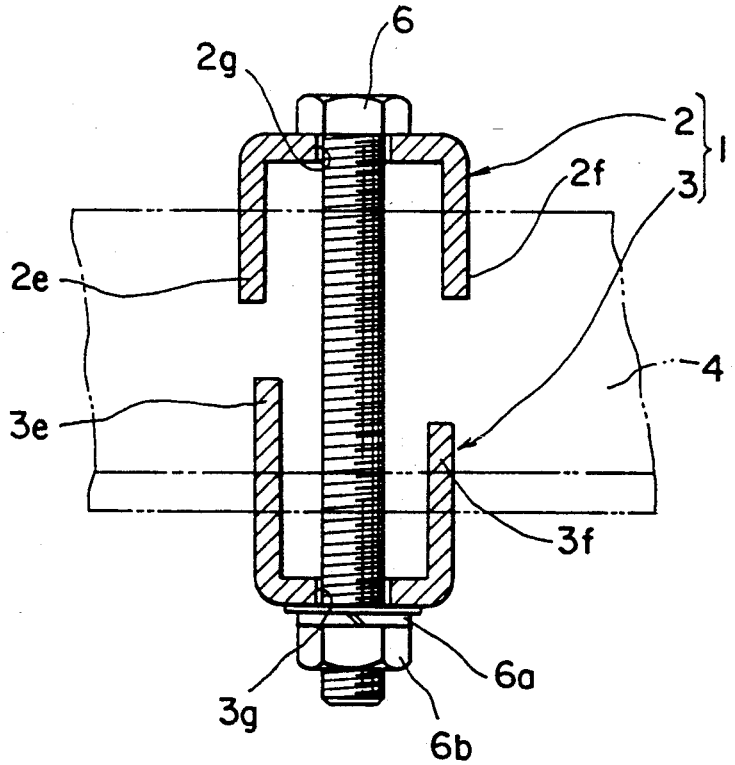
FIG. 8 is a side view of supporting metal fittings for double beams according to a second embodiment of the present invention.

According to the first embodiment, the fixing member 6 is screwed into the screw hole 3*g* defined on the lower metal fitting 3. However, the lower metal fitting 3 may have a small hole 3*h* therein through which the fixing member 6 is inserted and fixed by a nut 6*b* by way of a washer 6*a* as illustrated in FIG. 8.

Figure 9:
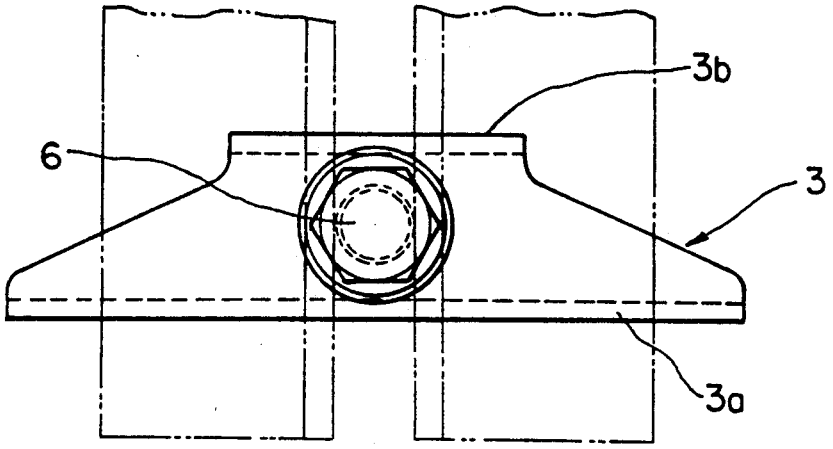
FIG. 9 is a plan view showing the supporting metal fittings for double beams according to the second embodiment of the present invention.
Figure 10:
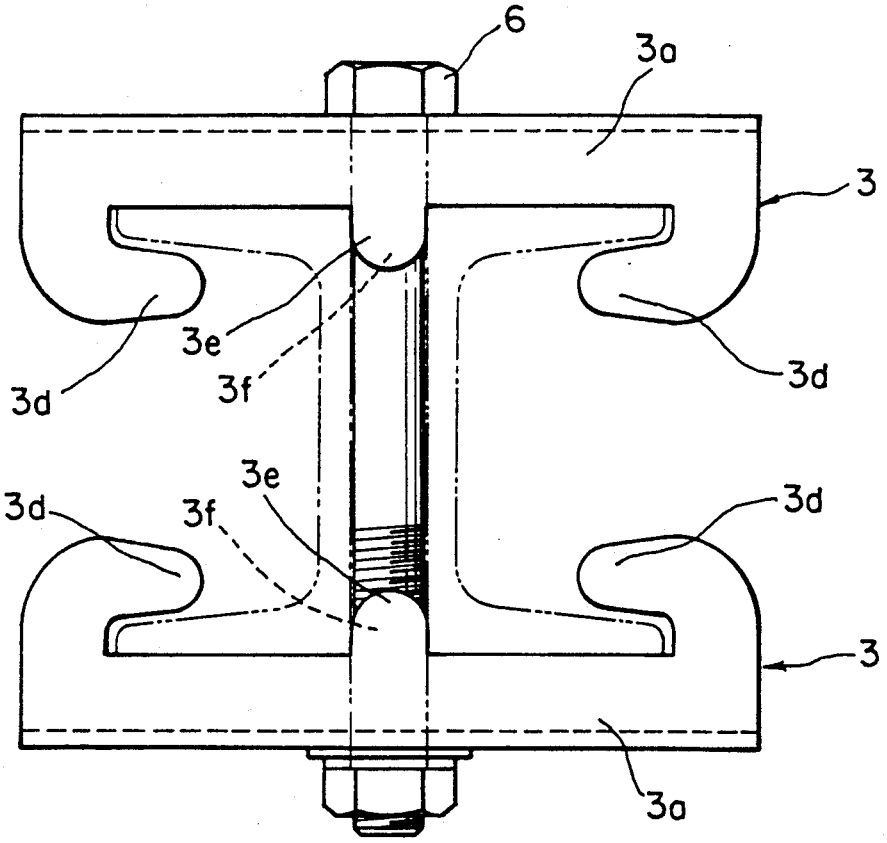
FIG. 10 is a front view of the supporting metal fittings for double beams in FIG. 9.
Figure 11:
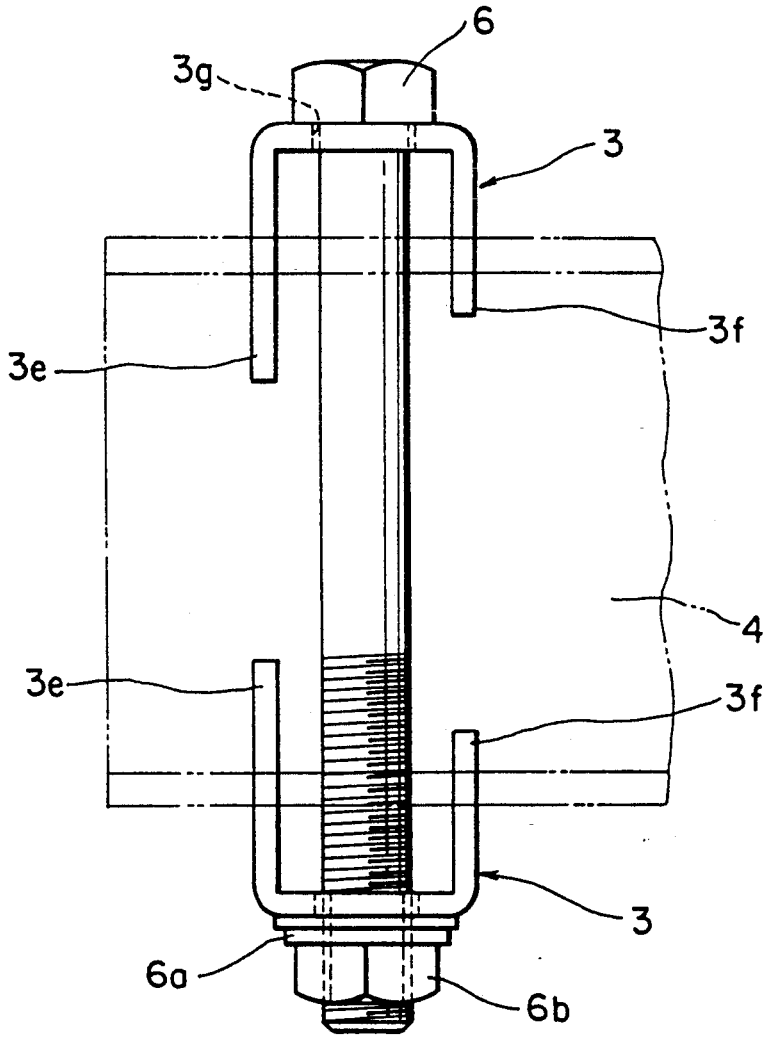
FIG. 11 is a side view of the supporting metal fittings for double beams in FIG. 9.

Although the double beams 4 according to the first embodiment comprise two sides, the supporting meal fittings according to the second embodiment can accommodate double beams 4 each comprising a third side substantially parallel to the second side and rigidly secured to an adjacent end of the first side (C-shaped beams). In the second embodiment, the notched portions of the upper metal fitting 3*a* are engaged with, and securely retain the third sides of the double beams as illustrated in FIGS. 9 to 11.

It is possible to remarkably reduce the time and labor involved in the manufacturing the double beams for suspending the ducts, pipes, air conditioners, etc. from the ceiling of a building compared with conventional double beams which have been manufactured using angles or channels machined at the factory.

Furthermore, since the double beams can be manufactured with ease at the building site to cope with an arbitrary hanging load, it is not necessary to previously manufacture and keep a plurality of double beams at a factor so that it is possible to reduce the space and labor for keeping the same, which results in a remarkable cost reduction.

Furthermore, inasmuch as non-machined beams are cut to a necessary length at the building site, remaining portions can be used for other purposes, so as to eliminate a waste of materials.

What is claimed is:

1. A fitting device for rigidly connecting first and second beams in a back-to-back spaced apart arrangement which defines a gap therebetween, each said beam having a first side which defines one boundary of said gap extends at an angle of approximately 90 degrees away from a second side, said first and second sides of each beam being rigidly joined at adjacent ends thereof with said second sides projecting outwardly in opposite directions away from said gap, said device comprising:

a downwardly facing, substantially U-shaped, upper member including a central top plate having substantially parallel first and second end plates substantially perpendicularly secured to opposite ends thereof, said central top plate having a bore therethrough, said first end plate having two sidewardly spaced first notches which cooperate to define a first tongue part downwardly projecting therebetween, said first notches receiving therein upper ends of the first sides of the first and second beams respectively, and said first tongue part disposed within the gap, said second end plate also having a downwardly projecting second tongue part disposed within the gap;

an upwardly facing, substantially U-shaped lower member including a central bottom plate having substantially parallel first and second end plates substantially perpendicularly secured to opposite ends thereof, said central bottom plate having a bore therethrough, said first end plate having tow sidewardly spaced second notches which cooperate to define a third tongue part upwardly projecting therebetween, said second notches receiving therein the second sides of the first and second beams respectively, and said third tongue part disposed within the gap, said second end plate also having an upwardly projecting fourth tongue part disposed within the gap; and a fixing means for extending between and rigidly securing said upper and lower members together in fixed securement to the first and second beams.

2. The device as claimed in claim 1, wherein said central top and central bottom plates are substantially trapezoidal in shape and each has a wide end and a narrow end, said first end plate of the upper member and said first end plate of the lower member being secured to the wide ends of the central top and central bottom plates, respectively, and said second end plate of the upper member and said second end plate of the lower member being secured to the narrow ends of the central top and central bottom plates, respectively.

3. The device as claimed in claim 1, wherein said fixing means is a bolt disposed within the gap and passing through the bores in the central top and bottom plates, said bolt also serving to support an object suspended therefrom.

4. The device as claimed in claim 3 wherein said object is a duct.

5. The device as claimed in claim 3 wherein said object is a pipe.

6. The device as claimed in claim 3 wherein said object is a support platform for supporting an air conditioner, or the like.

7. The device as claimed in claim 1, wherein said first, second, third, and fourth tongue parts have substantially equal dimensions for substantially maintaining a desired gap dimension along the longitudinal axis of the first and second beams.

8. The device as claimed in claim 1, wherein said first end plate of the lower member includes first and second retaining portions secured to upward portions of the second notches, respectively for engaging an upper surface of each second side of the first and second beams, respectively.

9. The device as claimed in claim 1 wherein each said first and second beams further comprise a third side substantially parallel to the second side and rigidly joined to the first side at adjacent ends thereof so that each beam is of a generally C-shape, and said first notches receive therein the third sides of the first and second beams, respectively.

10. The device as claimed in claim 9, wherein said first end plate of the upper member includes first and second retaining portions secured to downward portions of the first notches, respectively for engaging a lower surface of each third side of the first and second beams, respectively.

11. A supporting metal fitting for a double beam arrangement wherein each of two beams include first and second sides extending in an angled relationship, said beams being disposed with the first sides in a back-to-back spaced apart relationship, said supporting metal fitting comprising:

a one-piece upper metal fitting having sidewardly-spaced first notched portions in which upper portions of the first sides of the two beams are engaged, said upper metal fitting also having a first tongue portion which engages between the first sides of the two beams;

a one-piece lower metal fitting having sidewardly-spaced second notched portions in which the second sides of the two beams are retained, said lower metal fitting also having a second tongue portion positioned between the second notched portions for engagement between the two beams; and a fixing member positioned between the first sides and coupled to both the upper and lower metal fittings for fixing them together.

12. The device as claimed in claim 11 wherein each said first and second beams further comprise a third side substantially parallel to the second side and rigidly joined to the first side at adjacent ends thereof so that each beam is of a generally C-shape, and said first notched portions receive therein the third sides of the first and second beams, respectively.

13. The device as claimed in claim 12, wherein said upper metal fitting includes first and second retaining portions secured to downward portions of the first notched portions, respectively for engaging a lower surface of each third side of the first and second beams, respectively.

* * * * *

UNITED STATES PATENT AND TRADEMARK OFFICE

CERTIFICATE OF CORRECTION

PATENT NO. : 5 259 165

DATED : November 9, 1993

INVENTOR(S) : Masayoshi Koyama

It is certified that error appears in the above-identified patent and that said Letters Patent is hereby corrected as shown below:

Column 5, line 18; change "tow" to ---two---.

Signed and Sealed this

Seventeenth Day of May, 1994

Bruce Lehman

*Attest:*

BRUCE LEHMAN

*Attesting Officer*

*Commissioner of Patents and Trademarks*